United States Patent [19]

Ginefra, Sr.

[11] 4,112,672

[45] Sep. 12, 1978

[54] CLOCK DISPLAY DEVICE

[76] Inventor: Anthony Ginefra, Sr., 1184 Rockaway Ave., Brooklyn, N.Y. 11236

[21] Appl. No.: 706,143

[22] Filed: Jul. 19, 1976

[51] Int. Cl.[2] ..... G04B 37/00

[52] U.S. Cl. ..... 58/53; 58/88 GE; 58/54

[58] Field of Search ..... 58/53, 54, 55, 56, 88 G, 58/89, 127 R, 127 B, 125 R, 126 R, 52 R; 40/11 R, 20 A, 104.13; D10/1, 2, 5–13

[56] References Cited

U.S. PATENT DOCUMENTS

| | | | |
|---|---|---|---|
| D. 131,206 | 1/1942 | Hodge | D10/8 X |
| D. 146,406 | 2/1947 | Faor | D10/8 |
| D. 221,674 | 8/1971 | Emdur | D10/8 |
| 1,428,902 | 9/1922 | Porter | 58/56 |
| 1,832,359 | 11/1931 | Carlson | 58/53 |
| 2,558,518 | 6/1951 | Heymann | 58/54 |

*Primary Examiner*—Ulysses Weldon
*Attorney, Agent, or Firm*—Paul J. Sutton

[57] ABSTRACT

A clock housing provided with interchangeable clocks which have different face designs.

1 Claim, 3 Drawing Figures

CLOCK DISPLAY DEVICE

BACKGROUND OF THE INVENTION

This invention relates to a clock housing provided with interchangeable clocks.

It is often desirable for advertising purposes or decorative purposes to ornament a clock face with particular indicia lending itself to the decor of the surrounding environment. For example, people of a particular religious faith may desire to ornament a room in a house with particular religious symbols, yet retain a functional embodiment of the ornamented object, such as a clock, to draw attention to the symbols. Similarly, symbols related to the various professions and vocations are often used for display ornamentation in offices and buildings to convey to the public the professional or vocational affiliation of the occupant. This invention provides a device for mounting such interchangeable informational ornamentation in association with a clock.

SUMMARY OF THE INVENTION

In accordance with the invention, a clock housing having a distinctive shape or design is provided with a bore for receiving interchangeable clocks having different face designs along with their clockwork mechanisms. Spring clips in the bore removably mount the clock and clockwork mechanism to the housing. Different symbolic plaques are also removably mounted on the housing which match the decor of the clock face.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
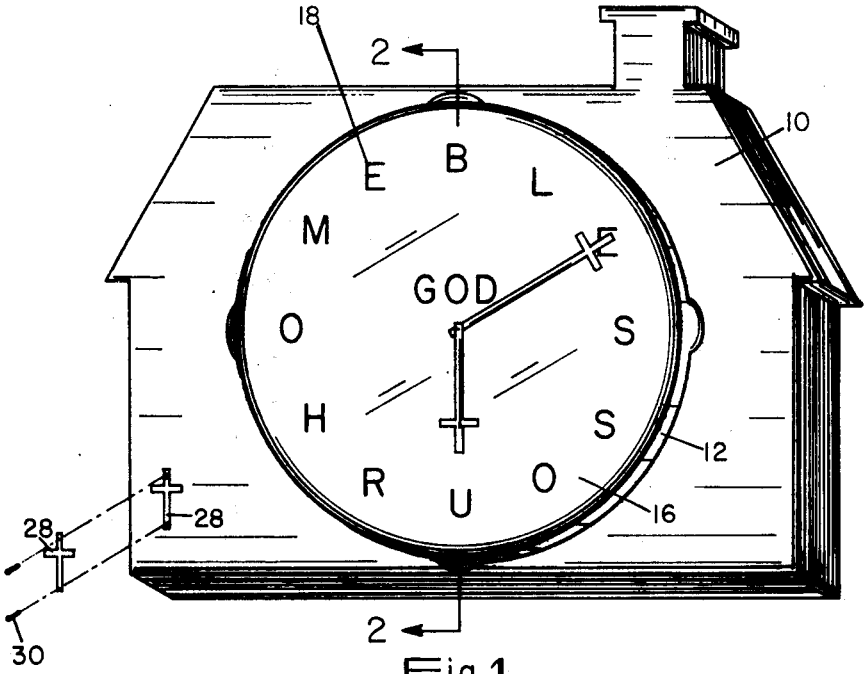
FIG. 1 is an exploded perspective view of the clock and clock housing of the present invention.
Figure 2:
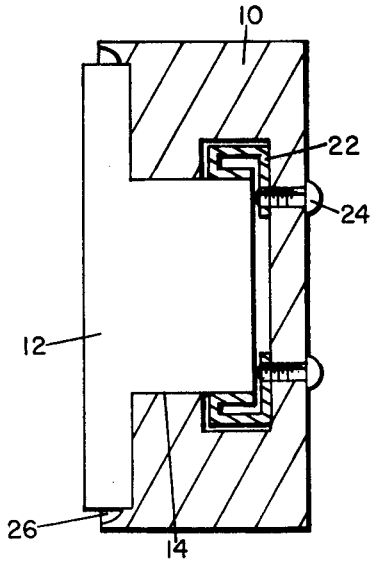
FIG. 2 is a cross-sectional view taken substantially along the plane indicated by line 2—2 of FIG. 1.

Referring now to the drawing in detail, wherein like numerals indicate like elements throughout the several views, the present invention includes a clock housing 10 formed in a distinctive shape or design mounting a clock and clockwork mechanism 12 in a centrally located bore 14. As shown in FIG. 1, the housing 10 may be in the shape of a house. The clock face 16 of clock 12 may be inscribed with suitable indicum 18 in lieu of numbers, so a message such as "GOD BLESS OUR HOME" appears on the clock face 16. Similarly, the hands 20 of clock 12 may be in the form of religious ornamentation, such as a cross.

Resilient spring clips 22 may be mounted by screws 24 to circumscribe bore 14 to removably mount clock and clockwork mechanism in housing 10. Finger indentations 26 are provided on the front surface of housing 10 to enable a person to grasp the clock and clockwork mechanism 12 and pull it from retaining clips 22 so as to interchange the clock 12 with another clock bearing different display ornamentation which may be substituted between clips 22.

Figure 3:
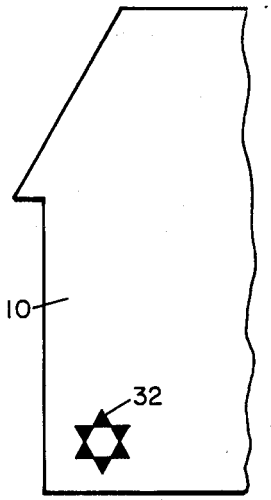
FIG. 3 is a partial front elevational view of the clock housing of FIG. 1 provided with an alternate form of ornamentation.

If desired, symbolic plaques 28 may also be removably mounted and secured by screws 30 on the front surface of housing 10. As shown in FIG. 3, a different plaque 32 may be substituted for plaque 28 which matches the decor of the clock face 16.

Also, because clock and clockwork mechanism 12 is removable, it may be regularly wound by a key on its rear face.

I claim:

1. A time keeping display device comprising, in combination: a housing portion formed of a predetermined decorative shape, said housing portion being formed with a clock-receiving cavity therein, said clock-receiving cavity occupying a portion of said housing portion normally viewed by a user, said housing portion being further formed with an annular clip receiving cavity which communicates coaxially with respect to said clock-receiving cavity, said housing portion being yet further formed with a pair of fastener openings through a rearward side thereof and each communicating with said clip receiving cavity, said housing portion being yet further formed with a pair of indentations proximate said clock-receiving cavity for accommodating the fingers of a user wishing to remove the contents of said clock-receiving cavity; a plurality of spring clips disclosed within said clip receiving cavity; a clock mechanism disposed and held within said clock-receiving cavity by means of said spring clips; and fasteners extending through said fastener openings for removably holding said spring clips.

* * * * *